US005778606A

United States Patent [19]

Davis, Jr. et al.

[11] Patent Number: 5,778,606

[45] Date of Patent: Jul. 14, 1998

[54] MODULAR BANK STATION

[76] Inventors: Louis O. Davis, Jr., 127 Thornton Dr., Palm Beach Gardens, Fla. 33418; Rita Groton, 6252 Floridian Cir., Lake Worth, Fla. 33463; Hunter T. Foy, 39 SW. 10th Ave., Boca Raton, Fla. 33486; Michael Thiem, 4303 SE. Grant St., Stuart, Fla. 34997

[21] Appl. No.: 642,458

[22] Filed: May 3, 1996

[51] Int. Cl.[6] ..... E04H 1/12

[52] U.S. Cl. ..... 52/36.2; 52/79.5

[58] Field of Search ..... 52/79.5, 79.1, 52/36.2, 36.1

[56] References Cited

U.S. PATENT DOCUMENTS

| | | | |
|---|---|---|---|
| 1,474,864 | 11/1923 | Vogt et al. | 52/36.2 |
| 4,471,586 | 9/1984 | Shuch et al. | 52/36.2 |
| 4,571,898 | 2/1986 | Le Cacheux et al. | 52/36.2 |
| 5,526,615 | 6/1996 | Kaizu et al. | 52/79.1 X |
| 5,615,623 | 4/1997 | Capraro et al. | 52/36.1 X |

*Primary Examiner*—Robert Canfield

*Attorney, Agent, or Firm*—Malin, Haley, DiMaggio & Crosby, P.A.

[57] ABSTRACT

A modular bank station unit for installation in building environments, such as stores, shopping centers, and office buildings, for providing full banking services, said modular bank unit comprising a pair of side walls and a rear wall bolted together to support a top enclosure, the top enclosure having compartments for storing video equipment. The unit also includes a front counter enclosure fully engaged with the side walls to enclose the unit and totally support the side walls, wherein the front enclosure provides opposing partitions, a customer window between the partitions, a plurality of cabinets, shelves, and bins for holding banking documents, a computer, a facsimile, and other banking equipment. The front enclosure provides a curved front surface to provide smooth customer flow.

53 Claims, 8 Drawing Sheets

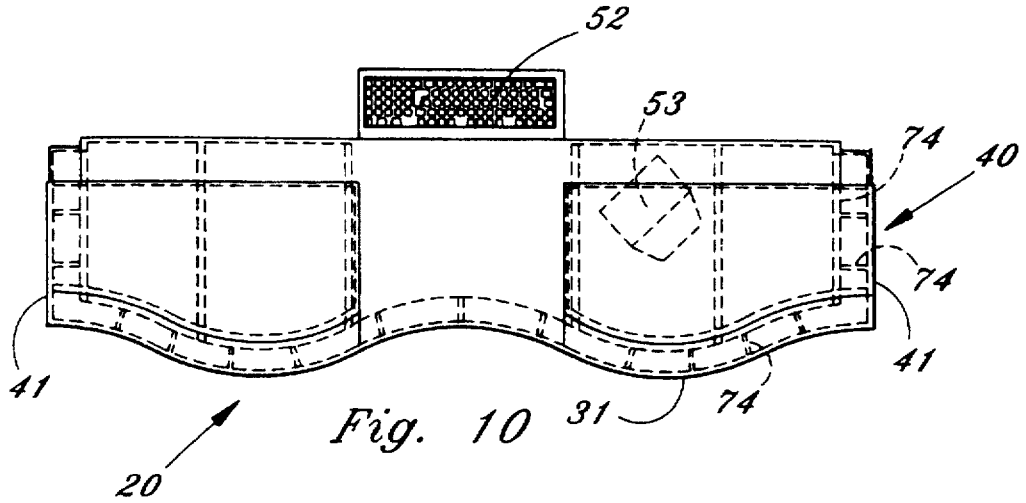
Fig. 10
Fig. 13a
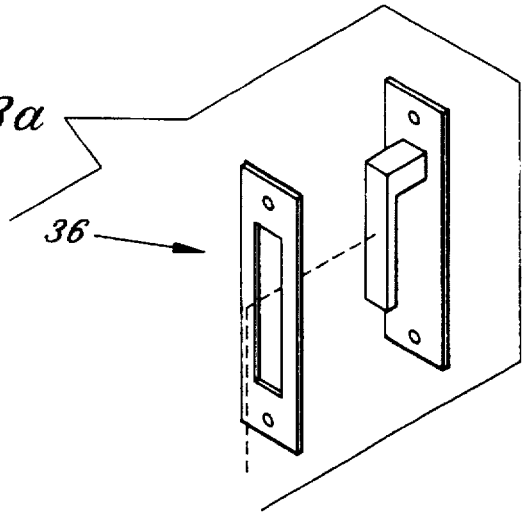
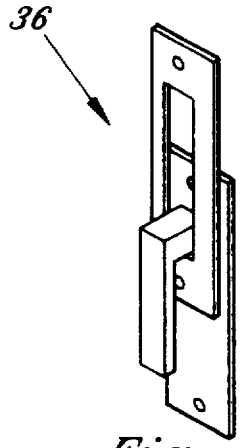
Fig. 13b
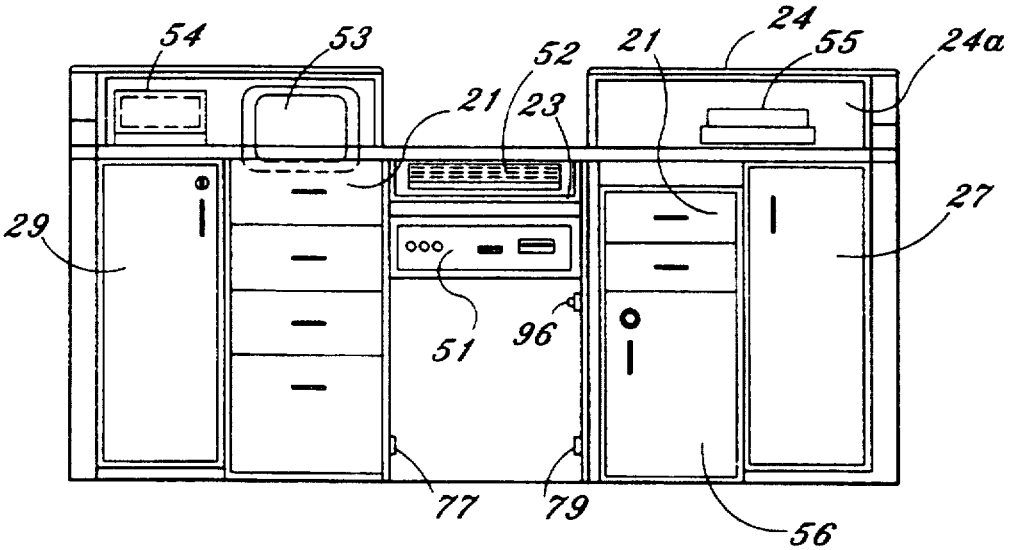
Fig. 9

MODULAR BANK STATION

BACKGROUND OF THE INVENTION

1. Field of the Invention

This invention relates generally to transportable banking facilities, and more particularly to a modular bank station for convenient, mobile, and quick installation within a store environment.

2. Description of the Prior Art

Supermarket banking is available today to customers through stationary bank facilities located in stores of many companies. The facilities vary in square footage and appearance. However, all existing facilities are constructed in such a manner as to be a permanent part of the store layout. The bank facilities usually have a teller counter area, with work space behind the counter, and may be comprised of one or more rooms, including a private office. The structures include a teller counter, walls, ceiling, cabinets, closets, etc. . . . which are all a permanent part of the overall store interior. Utilities to the bank facility, such as electricity and telephone, are also installed on a permanent basis, and no preparations are made for disconnecting service without actual disassembly of the wires and cables used to deliver the required services.

Current supermarket bank facilities are, therefore, permanent in design and construction, and cannot be moved from one location or store to another without necessitating complete disassembly and reconstruction. Consequently, there exists a need for an easily transportable and installable banking station. The instant invention addresses this need by providing a modular bank station that can be easily and quickly installed or connected, within any building facility, e.g., supermarket, retail store, mall, discount store, hospital, office building, plant, or any other structure consisting of walls, floors, ceiling, and readily available power, phone and other utilities. Likewise, the instant invention can be disconnected and moved to a new location. While the modular bank station is described below with respect to performing banking transactions, the instant invention may be adapted for performing any service oriented transactions including, but not limited to, fields such as insurance, money management, and real estate related services.

SUMMARY OF THE INVENTION

It is an object of the present invention to provide a modular bank facility that is easily and quickly installable inside any host environment including, but not limited to, stores, businesses, shopping centers, and office buildings.

It is another object of the invention to provide a modular bank station having prefabricated components that may be constructed without requiring legal permits or structural changes to the surrounding environment.

It is an additional object of the instant invention to utilize existing power and telephone outlets of the host facility and to provide a structure for conveniently connecting and disconnecting power and phone.

It is a further object of the instant invention to provide a modular bank station that does not require customization or structural changes to the host environment for installation of the modular bank station.

It is still another object of the instant invention to provide a modular bank station that may be expanded through the addition of adjacent stations connectable to the main base station.

It is still an additional object of the instant invention to provide a modular bank station that is adaptable for accommodating standard bank equipment in a single, efficient, operational environment.

It is still a further object of the instant invention to provide a self-contained bank delivery system for the teller or operator which affords maximum productivity relative to the space utilized.

Still another object of the instant invention is to present an image of a stable and compatible customer interaction area while being small in actual size.

It is yet another object of the instant invention to integrate a video loop for introducing product lines to customers via a video monitor which the operator can initiate and execute from the modular bank station.

It is yet an additional object of the instant invention to is provide a modular bank station having a structure which is protected from physical damage.

It is yet a further object of the instant invention to provide a modular bank station counter design that facilitates smooth customer traffic flow.

In accordance with these and other objects, the present invention comprises a modular bank assembly kit for constructing a station or facility having a number of corresponding prefabricated components that may be quickly assembled, installed or disassembled inside virtually any host environment without requiring structural changes to the surrounding area or building permits. The modular bank station of the instant invention incorporates complementing side ends, apertures, and connectors that allow the facility to be quickly and easily assembled. The instant invention further includes electrical and telephone adapters for conveniently connecting and disconnecting existing host environment power and telephone outlets and a counter that can accommodate standard bank equipment via power outlets, telephone jacks, shelves and storage space. Quick connect connectors, plugs or jacks for both electricity and telephone service may be secured to a side wall, the rear wall, the front counter or the top enclosure for selectively providing or removing power and telephone connections. The quick connect adapters provide power and phone service to predetermined outlets and jacks inside the modular bank facility.

The modular bank facility of the instant invention generally comprises a front counter, opposing side wall supports, a rear wall support, and a top enclosure. The walls, front counter, and top enclosure are prefabricated and constructed for secure engagement in forming the modular bank facility enclosure. Each side wall is attached to opposite side ends of the rear wall, and in combination, they provide support for the top enclosure which sits along the top surfaces of the wall supports. The wall support side ends may be bolted together and/or connected by way of integral corresponding tongue-in-groove ends or pocket joints. The wall supports are preferably stabilized and joined by hardware such as steel brackets and fasteners, including screws, bolts, or other fasteners that may be easily used and removed. The top ends of the side and rear wall supports preferably define a predetermined thickness and surface area sufficient for securely engaging and supporting the top enclosure together with hardware. Alternatively, the lower peripheral outside edge of the top enclosure may include or define a continuous groove or tongue for engaging corresponding ends along the top of the wall supports. The front ends of the side wall supports engage and mate with the front counter. The front counter provides both front and lower support for the side walls and defines the counter window (between the counter and top enclosure) and the customer window (between dual partitions) for transacting banking business. The main support for the top enclosure, however, is provided by the side wall and rear wall supports. The modular bank facility includes at least one hinged door for ingress and egress and this door may be in either side wall or the rear wall.

The top enclosure provides a plurality of angled louvers for allowing the filtration of light and conditioned air for cooling the enclosure, while facilitating the venting of heat from below the enclosure. The top enclosure also comprises a plurality of lights and light supports, a clock support, a VCR support and cabinet, and a video monitor support and cabinet. The video monitor cabinet secures and encloses a television monitor for running a continuous video loop to introduce product lines and services. Likewise, a VCR enclosure is also provided for supporting a VCR to be electrically connected to the television monitor for running selected tapes. Since the TV monitor and VCR are electrically connected, the instant invention may include conduit for running cables between the components and to the electrical outlets. Conduit may be employed for all wires and cables.

The front counter provides a curved front surface and customer counter-top for the comfort and convenience of customers, to present an image of stability and to facilitate smooth customer traffic flow. The rear side of the counter faces the interior volume of the modular bank enclosure and includes a plurality of file cabinet drawers, a computer platform or enclosure, an extendable keyboard drawer, and at least one drop box port. All drawers are preferably slidably supported on rollers, as is the keyboard drawer. Additional slidable drawers or table tops are also provided for supporting equipment such as facsimiles and printers. At least one safe is also provided for securing the bank's money.

The instant invention is preferably constructed from plywood and wood framing. The framing supports are secured in predetermined strategic locations for providing the best structural stability of the modular bank station walls, counter tops, and enclosures. The counter of the instant invention includes parallel raised partitions projecting from the top surface of the counter in a way that defines a customer window and a structure for concealing and protecting the computer monitor, documents, money, and supplies used by the teller. The walls, top enclosure and front counter are lightweight and easily disassembled and transportable to new locations for installation. In one embodiment, the top enclosure and front counter may be partially disassembled for ease of transport. The modular bank station includes at least one rubber or plastic bumper for protecting the finished surface of the bank station enclosure. In the alternative, the instant invention may also include removable or retractable rollers for conveniently relocating the modular bank station within its host environment.

In accordance with these and other objects which will become apparent hereinafter, the instant invention will now be described with particular reference to the accompanying drawings.

BRIEF DESCRIPTION OF THE DRAWINGS

FIG. 9 is a rear elevational view of the front counter enclosure of the preferred embodiment of the instant invention.

FIG. 10 is a top planar view of the top surface of the front counter of the instant invention.

FIG. 13*a* is a perspective view of the pocket joints separated in accordance with the instant invention.

FIG. 13*b* is a perspective view of the pocket joints connected in accordance with the instant invention.

DESCRIPTION OF THE PREFERRED EMBODIMENTS

Figure 1:
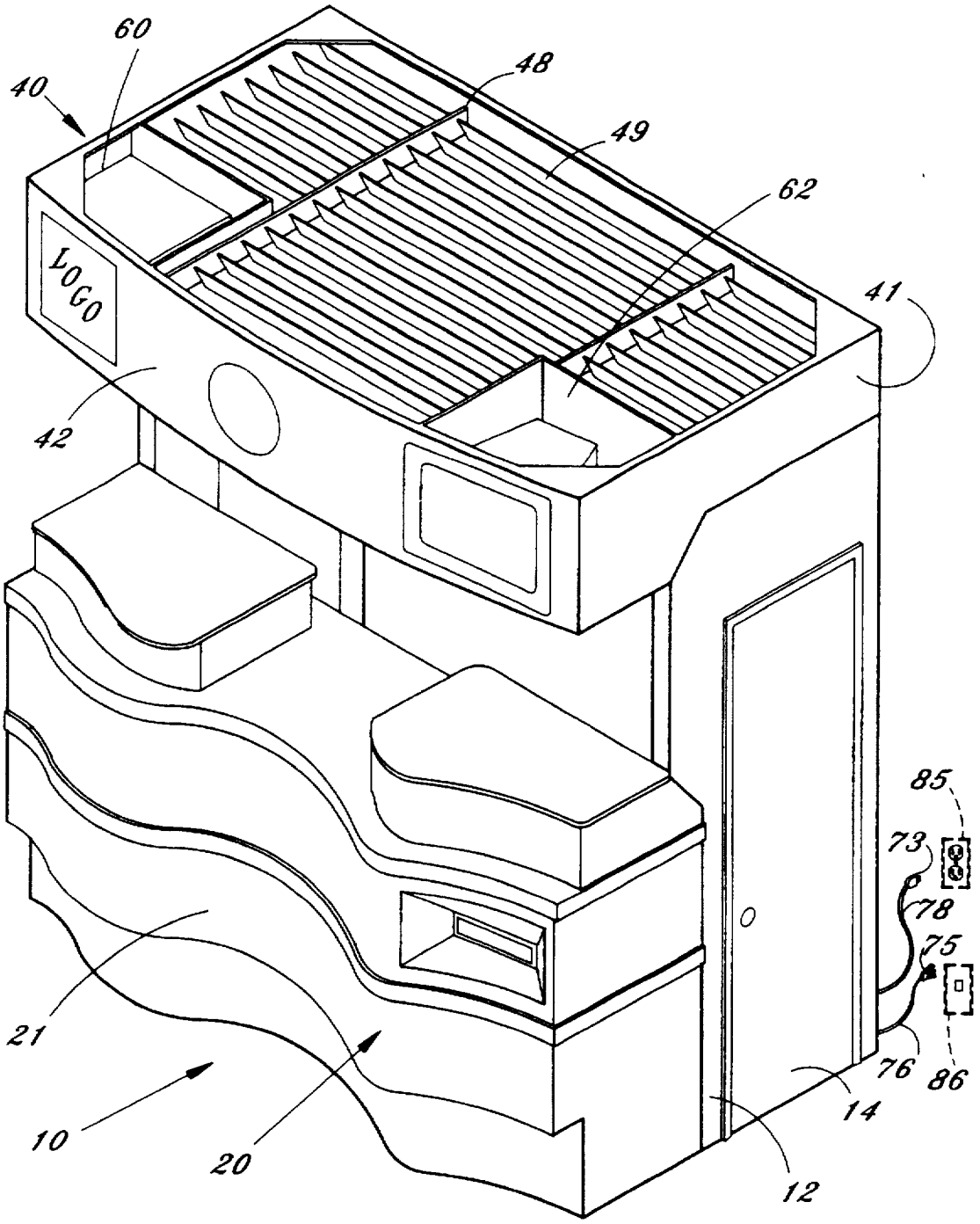
FIG. 1 is a front perspective view of the modular bank station of the instant invention.
Figure 2:
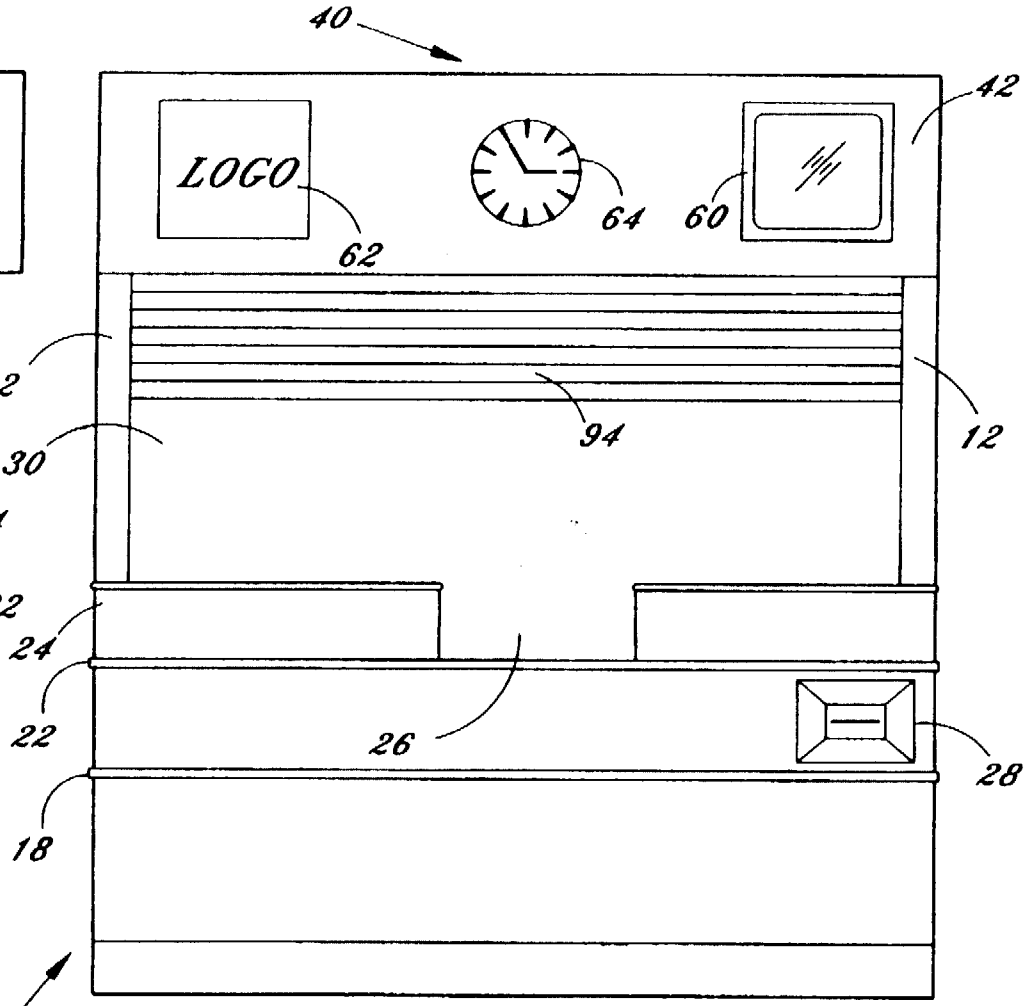
FIG. 2 is a front elevational view of the modular bank station of the instant invention.

With reference to the drawings, FIGS. 1–15 depict the preferred embodiments of the instant invention, which comprises a modular bank station assembly kit for the assembly and reassembly of a modular bank facility 10. The modular bank station 10 generally comprises a front counter enclosure 20, side wall supports 12, a rear wall support 30, a top enclosure 40, and a base platform 90. With reference to FIGS. 1–4, the side wall supports 12 and rear wall support 30 are attached with hardware and/or pocket joints 36 at corresponding edges and in combination attach and support the top enclosure 40 to form the modular bank station 10 of the instant invention. The pocket joints 36 comprise standard hardware which slidably mate to join and draw together the rear wall 30 and side walls 12, and the rear wall panels 30*a*, 30*b* in forming the rear wall 30, as seen in FIGS. 11*a*–13*b*. Likewise, the top enclosure 40 and/or front counter 20 may be secured to the walls 12 and/or 30 using pocket joints 36. The top enclosure 40 engages the top ends of the side walls 12 and rear wall 30 which together absorb the larger portion of the top enclosure's load. The lower side edges 47 of the top enclosure 40 and the top ends of the walls 12, 30 are engaged and bolted together by hardware such as brackets and fasteners known in the art. They may also be joined together with corresponding pocket joints. Alternatively, the top enclosure 40 and walls 12, 30 may include corresponding tongue-in-groove ends for secured attachment. Likewise, the side walls 12 and rear wall 30 are bolted together with conventional hardware, but in the alternate may have corresponding tongue-in-groove ends or pocket joints for secured mating attachment. Additional modular bank stations 10 may be cascaded or fastened together side by side to form multiple stations having access therebetween via the doors 14. The platform 90 forms a base at the bottom end of the facility to preferably support the side and rear walls 12, 30 and to create a space between the platform 90 and host environment floor. In this space, conduit or channels 91 may be placed to enable the running of power and phone cables. The platform 90 may also support the counter. An added benefit of the platform 90 is that the teller is elevated so they are more easily seen.

Figure 4:
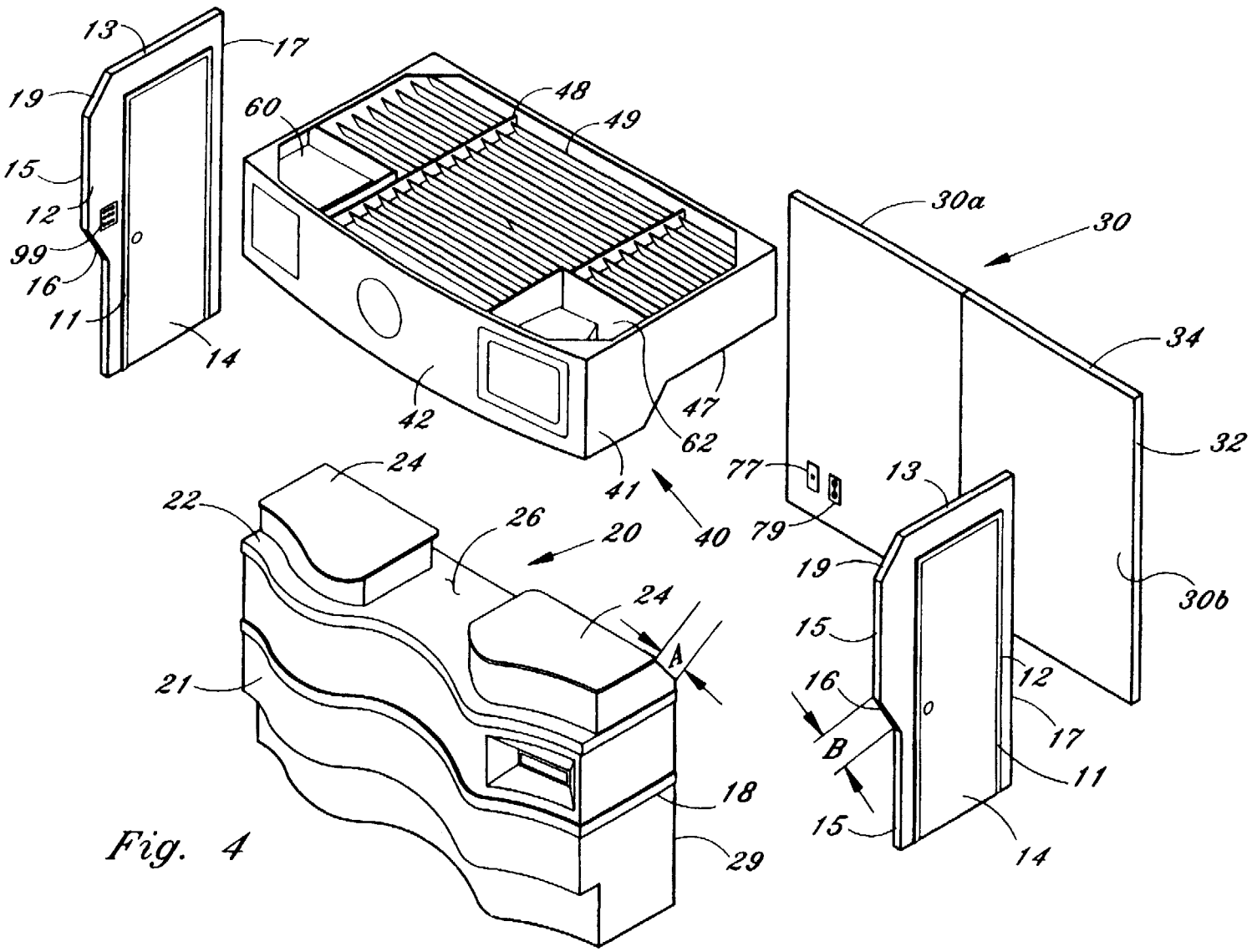
FIG. 4 is an exploded perspective view of the preferred embodiment of the modular bank station of the instant invention.
Figures 11A, 11B, 12A, 12B, 12C:
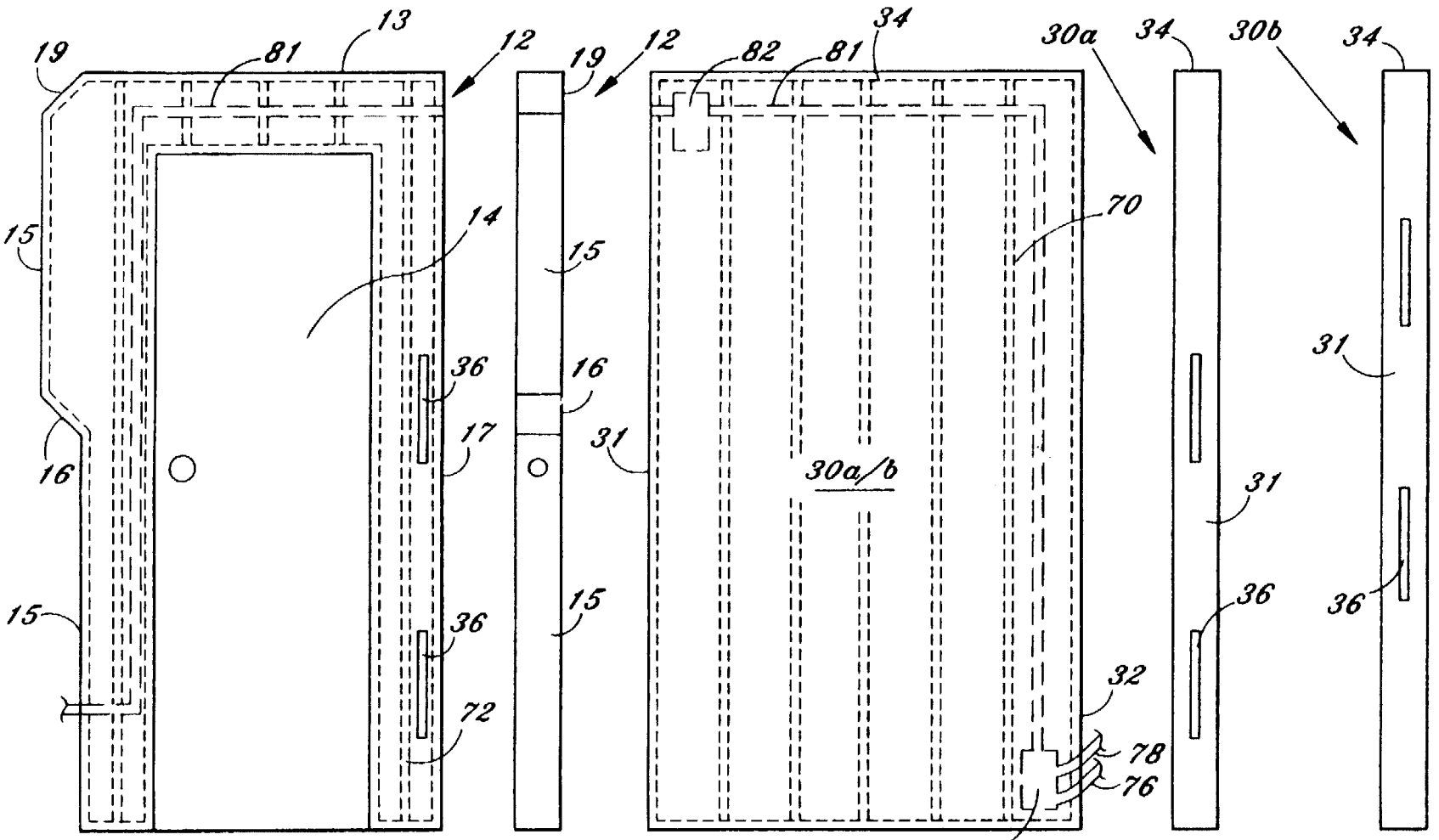
FIG. 11*a* is an elevational side view of the side wall of the instant invention.
FIG. 11*b* is an elevational end view of the side wall of the instant invention.
FIG. 12*a* is an elevational side view of the panels of the rear wall of the instant invention.
FIG. 12*b* is an elevational end view of one panel of the rear wall of the instant invention.
FIG. 12*c* is an elevational end view of a second panel of the rear wall of the instant invention.
Figure 14:
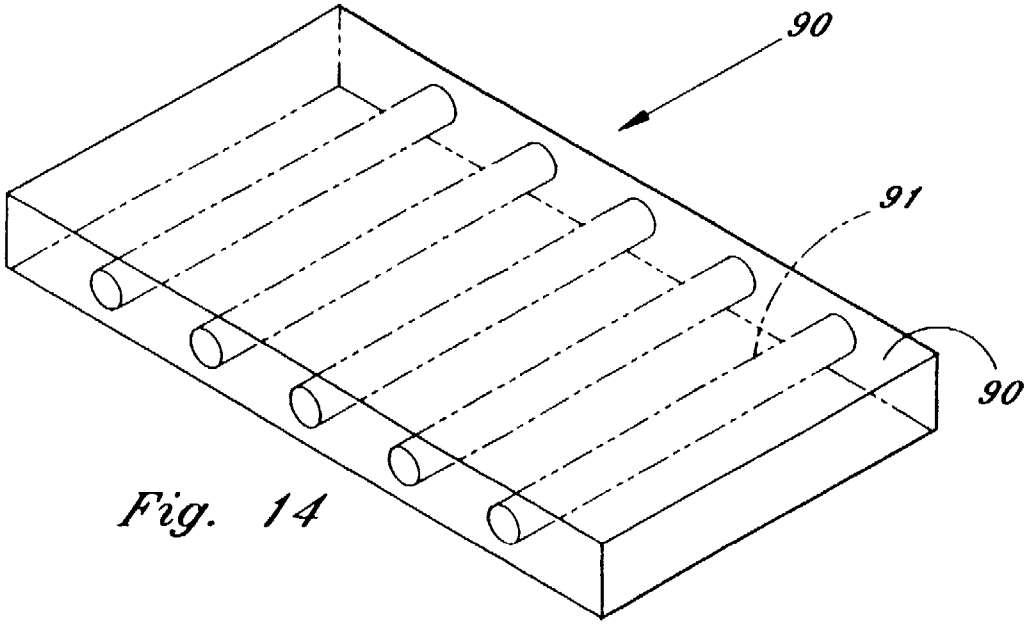
FIG. 14 is a perspective view of the base/platform of the instant invention.
Figure 15:
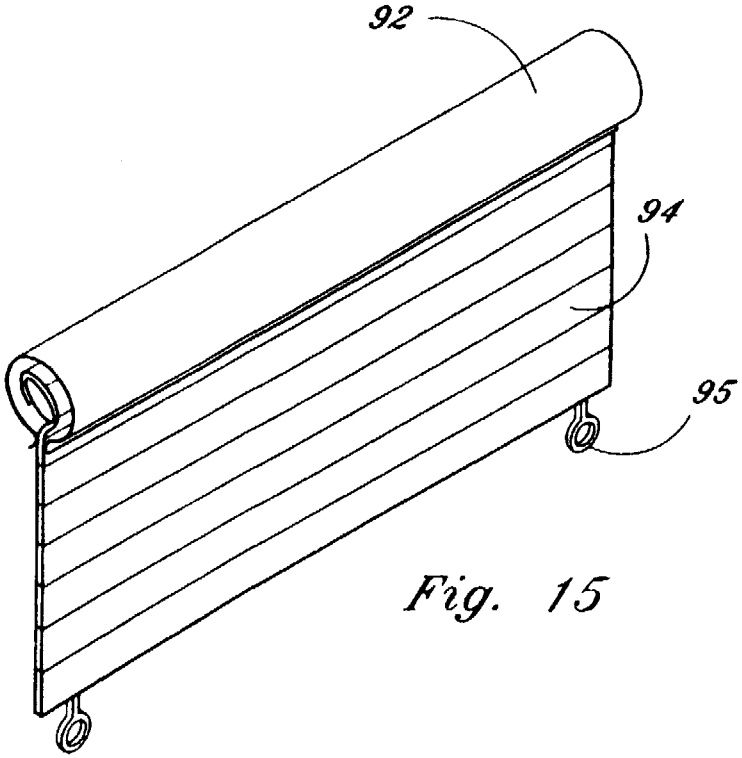
FIG. 15 is a perspective view of the security crate door and crate housing of the instant invention.

Referring to FIGS. 1, 4, and 10, the front counter unit 20 comprises a counter-like enclosure for conducting business and generally includes a counter top 22, two partitions 24 spaced apart on top of the counter top 22 to define a customer window, a bumper 18 stretching across the enclosure, storage bins 24*a*, and file cabinet drawers 21, walls 25, and a curved front surface 25*a*. The counter 20 is adapted for storing, powering and connecting standard bank equipment, such as computers 51, phones 58, modems, facsimiles, copiers and adding machines, for storing bank supplies and for accommodating customer transactions. In addition, the bank unit 10 is set up to provide a security system 57. Thus, the bank unit 10 receives a source of power 78 and telephone 76 service via standard plug adapters 73,75 to accommodate the above noted accessories, as well as light, air conditioning and/or any equipment necessitating standard AC power. The adapters 73, 75 may comprise any known connectors, plugs or jacks in the art. From the adapters 73, 75, outlets 77 and jacks 79 receive the requisite power or phone service. The connectors 73, 75 and outlets 77, 79 may be secured to the rear wall 30 and the front counter 20, respectively, or to any other wall without departing from the scope and spirit of the instant invention. This source of power 78 and phone service 76 is preferably provided with outlets 77 and 79 that are supplied power and service from the host environment through cables and conduit 81, as seen in FIGS. 11*a* and 12*a*. Telephone or telecommunication service is preferably provided by existing lines in the host environment which connect to the station 10 via standard electrical junction boxes 82, but in the alternative, additional lines may be added and dedicated to the station 10. The front counter 20 has a rear side end 25*c* which engages the lower half of the front end 15 of the side wall supports 12. The side wall supports 12 are preferably secured to the front counter enclosure 20 by way of brackets, bolts, and other hardware known in the art. The front counter closure 20 provides a lateral force on the front end 15 of the side wall supports 12, adding additional stability to the modular bank station 10 of the instant invention. The lower portion of the front end 15 actually engages a notch at both ends of the rear outside edge 25*c* of the counter 20, while the top portion of the front end 15 partially overlaps the top of the counter 20 and partition 24. The front end 15 of each side wall has an angled edge 16 that corresponds to and mates with a notch defined in the partition 24 for a clean fit.

Since the modular bank station 10 of the instant invention is intended to provide full banking facilities, the front counter 20 includes adapters secured in its framework for making power and phone connections between store power and phone outlets and the computer 51, telephone 58, security 57, and modem peripherals contained in the station 10. Additional equipment may be used and connected in operating the facility 10 without departing from the scope and spirit of the instant invention since the facility 10 provides power and telephone outlets for connecting selected equipment. With reference to FIG. 9, banking equipment and supplies are stored and supported in the rear section of the counter 20 in drawers, shelves and cabinets. A slidable keyboard drawer 23 is preferably located centrally in the counter in alignment with the customer window 26. At least two spatially opposed partitions 24 are attached by conventional hardware or adhesives to the top surface of the counter 20 for defining at least one customer window 26. The partitions 24 also provide at least two bins or pigeonholes 24*a* which may be used to store bank document copies, supplies, the computer monitor 53, the printer 55, and the facsimile 54 and to conduct banking transactions. The partitions 24 also conceal the banking documents and supplies from customer view for added security and organization. A plurality of slidable file cabinet drawers 21 may be included on opposite sides of the keyboard drawer 23. The file cabinet drawers 21 are preferably secured on rollers for convenient access. As shown in FIG. 9, a security safe 56 should also be provided. Since banking is conveniently done among various branches through computer networks, the instant invention provides space and shelves 59 for placing a computer 51. The monitor 53 is preferably supported above the computer within one partition cavity 24*a*, as previously discussed. A drop box 29 is placed in alignment below the chute 28 for receiving deposited documents. A slide may be inserted to join the chute port 28 and drop box 29. Although not shown, the counter enclosure 20 may include retractable rollers on its bottom surface for easily repositioning the banking facility 10 within its host environment.

Banking equipment and money is protected inside the facility 10 by a security system which includes a plurality of security breakers electrically connected to at least one security alarm and one activation key pad 99 which are tied into a local police station. A security panic button 46 may also be wired and attached at the teller work station below the customer window for signaling the police in the event of a robbery. To secure the facility at night, a pull-down security crate or door 94 is attached to the ceiling/top enclosure for extending down below the counter to close off the interior office volume of the facility. The security crate 94 is rolled out of housing 12 and preferably locks to the counter enclosure or base platform 90 from inside the facility. The crate 94 may be manufactured from stainless steel and may be corrugated. The crate 94, as well as other doors and openings in the facility 10, are preferably electrically connected to the security system alarms and/or key pad 99.

With reference to FIGS. 1, 4, and 10, the front counter enclosure 20 defines a curved continuous front wall 25*a* to facilitate comfortable customer access to the customer window 26. The curved structure of the front wall 25*a* provides a central lagoon in alignment with customer window 26 to give the customer some autonomy with the teller and to afford the smooth flow of customer traffic. Without a defined space for conducting business, crowding could occur at the customer window 26. To protect the outer surface of the counter enclosure 20, a bumper 18 is attached along the outer surface of the counter 20, extending across the front 25*a* and sides 25*b*. The bumper 18 may comprise a plastic or rubber and may be attached by adhesives or hardware.

With reference to FIGS. 1, 4, and 11 *a*,*b* the instant invention includes two opposing side wall supports 12, at least one of which includes a door 14. The side wall supports 12 define a top end 13, a front end 15, a rear end 17 and a front end extension defined between a first angled corner end 19, joining the top end 13 and the front end 15, and a second angled edge 16. The top end 13 of each side wall 12 engages the top enclosure unit underside 47, such that the exterior side wall surface abuts the edge of the top enclosure for a smooth surface. The top end 13 is substantially planar and has a width that facilitates a large attaching surface area to increase the support and limit the required hardware. The hardware preferably comprises bolts, brackets, and similar fasteners. The top end 13 may have a width that ranges between two (2) and five (5) inches. Alternatively, the top end 13 may mate with the bottom edge 47 of the top enclosure 40 by tongue-in-groove or pocket joints. Being on opposite sides of the top enclosure, the side wall supports 12 provide the majority of the stabilizing force for supporting the top enclosure 40. The rear wall support 30 abuts up against the inner surface of the side walls 12 along the rear ends 17 so that the rear ends 17 and the exterior surface of the rear walls 30 are aligned for a smooth finish. Once again, the walls 12, 30 are bolted together, but may also include tongue-in-groove or pocket joints.

The side walls 12 define a first angled corner edge 19 joining the top end 13 and front end 15, and a second angled corner 16 at a midsection. The angled edges 19, 16 essentially extend an upper portion of the front end 15 further out than the lower portion 15. Thus, the upper half of front end 15 partially overlaps the counter enclosure 20 when the modular bank facility 10 is completely constructed. The partitions 24 have corresponding angled outside notched edges **24*b* for mating with the rear walls' angled corners 16. The overlap and angled connection are intended to enhance stability, provide a more complete enclosure, and create an attractive unit 10. The lower half of the front ends 15 engage the rear side edges 25*c* of the counter enclosure 20 so as to gain some stabilizing force from the counter enclosure 20. The angled corner edges 19 comprise an angle which mates to a corresponding angled side edge of the top enclosure 40. This angle helps to provide a fuller, more stabilizing engagement between the top enclosure 40 and the rear side walls 12. At least one hinged door is attached to an opening in at least one side wall 12. Conventional hinges may be used. A frame 11 is constructed around the door opening in the side wall 12**, as is customarily known. In the alternative, the instant invention may also include removable or retractable rollers attached to the bottom of the counter and/or walls for conveniently relocating the modular bank station within its host environment.

With reference to FIG. 4, the rear wall support 30 comprises a substantially planar surface for providing a rear support stabilizing force for the top enclosure 40. The rear wall 30 comprises two panels **30*a* and 30*b* joined together along an interior side end 31. At least one pair of slide hook couplers 36 is secured, preferably with hardware, on each interior side end 31. The slide hook couplers 36 are offset between each panel 30*a*, 30*b* as they interact with each other for full secured engagement between the panels 30*a*, 30*b*. Once joined, the two panels 30*a*, 30*b* form the rear wall 30. It should be noted, however, that a single panel may be used for the rear wall 30 so long as the back end of the modular bank 10 is enclosed. The two panels 30*a*, 30*b*, however, facilitate convenient transportation and assembly because of the ability to handle smaller sections. The rear wall 30 includes a top end 34 which engages the underside 47 of the top enclosure 40. The rear lower edge of the top enclosure 40 and the top end 34 of the rear wall are bolted together but may have corresponding tongue-in-groove ends. Likewise, the side ends 32 of the rear wall 30 attach to the interior surface of the side walls 12 along the edge of the side wall rear ends 17 so that the exterior surface of the rear wall is aligned with the side walls' 12 rear ends 17. The rear wall 30 and side walls 12** are preferably bolted together, but a tongue-in-groove or pocket joint connection may be made. With any of the tongue-in-groove connections disclosed herein, an adhesive may be employed for a more permanent attachment.

Figure 3:
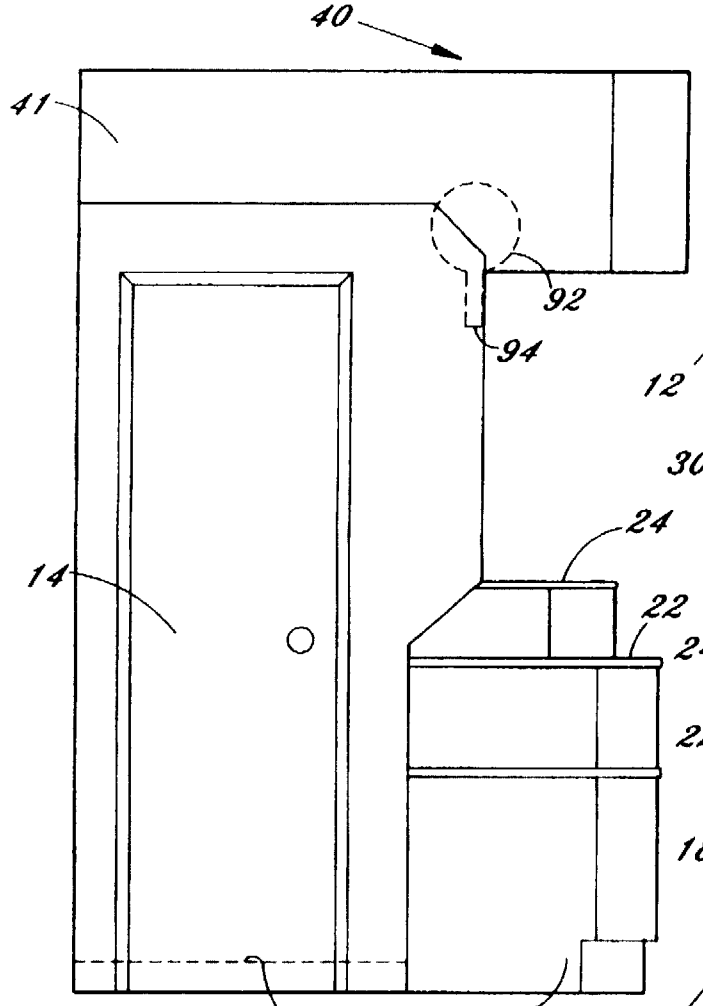
FIG. 3 is a side view of the modular bank station of the instant invention.
Figure 5:
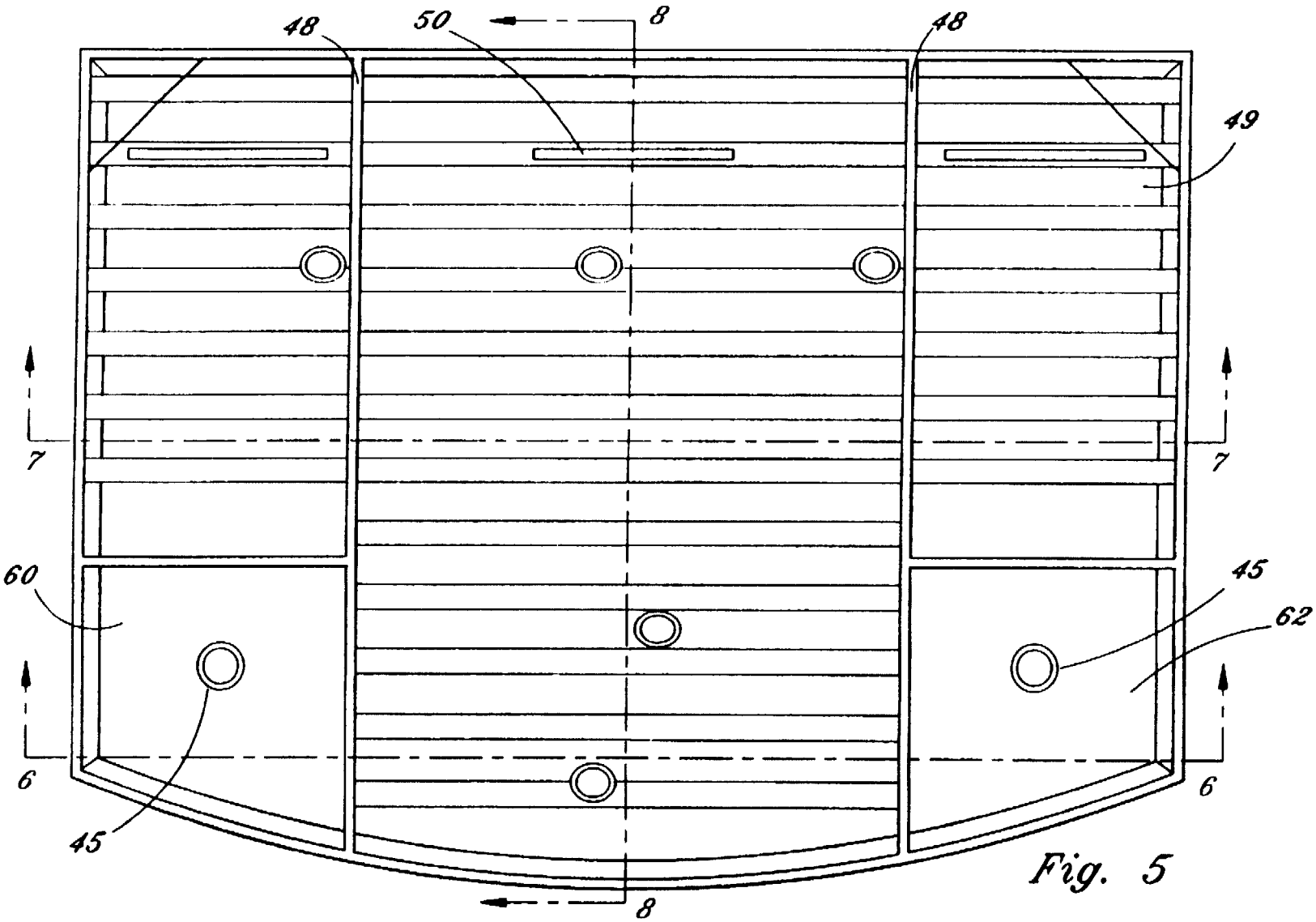
FIG. 5 is a top planar view of the preferred embodiment of the top enclosure of the instant invention.
Figure 6:
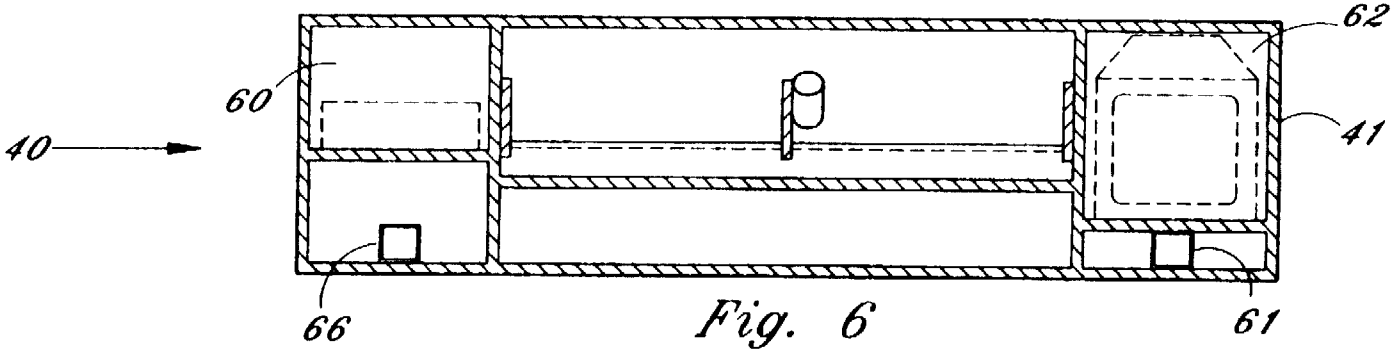
FIG. 6 is a cross sectional view of the top enclosure taken along line A—A of FIG. 5.
Figure 7:
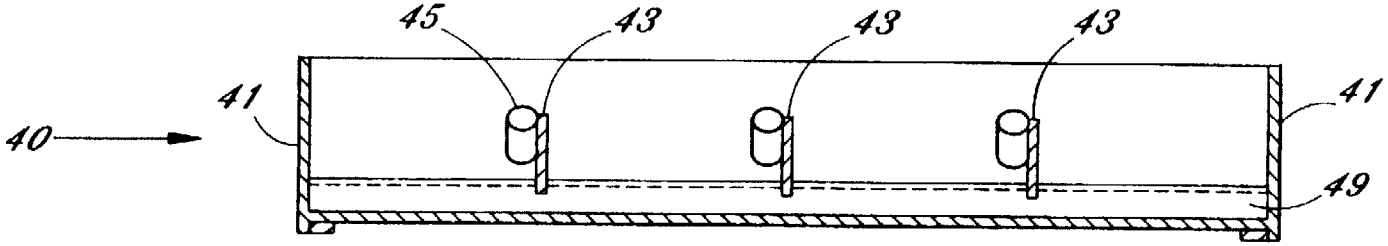
FIG. 7 is a cross sectional view of a section of the top enclosure taken along line B—B of FIG. 5.
Figure 8:
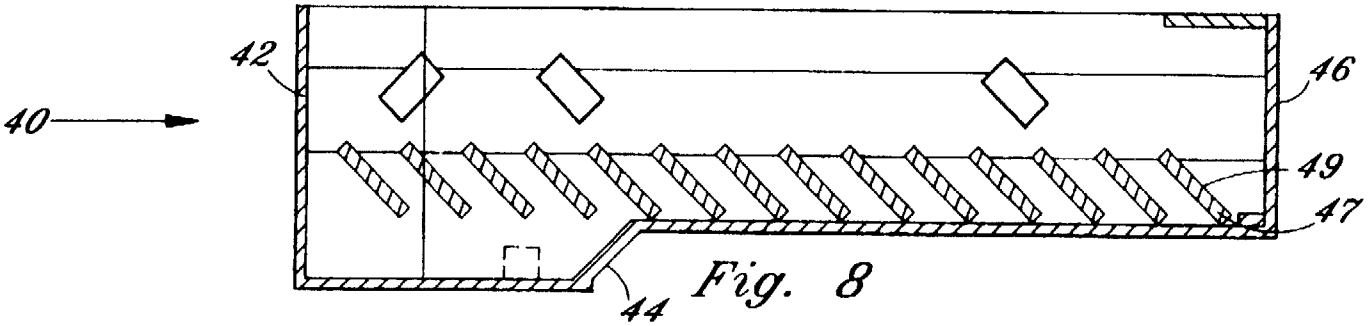
FIG. 8 is a cross sectional view of a section of the top enclosure taken along line C—C of FIG. 5.

With reference to FIGS. 1–8, the top enclosure unit 40 comprises side panels 41, a front panel 42, light supports 43, TV compartment 62, spotlights 45, VCR compartment 60, lower side edges 47, louver partition supports 48, and a plurality of louvers 49. The enclosure 40 comprises side panels 41 and a front panel 42 which may be securely bolted together with hardware brackets and fasteners. Alternatively, the panels may define tongue-in-groove ends or pocket joints for additional security. Likewise, the enclosure 40 includes a rear panel 46 secured to the side panels 41 with hardware. The lower side edges 47 of the top enclosure 40 engage the top ends of the support walls 12, 30 as discussed above. The side panels 41, as seen in FIG. 3, have an angled corner section 44 along the lower edge for mating with the angled corner edge 19 of the side walls 12 to enhance stability in the station 10. This angled corner section 39 transitions the side panel to a stepped section for overlapping the side wall 12 in alignment with the front counter unit 20. With reference to FIG. 6, at least two compartments may be formed in the top enclosure 40 for enclosing a television and VCR, or other selected equipment, which are powered by the electricity provided to the station 10 through the electrical outlets. The compartments 44, 60 are framed inside the top enclosure 40 to substantially form a box. For instance, a TV compartment 62 may be formed on one side contiguous with one side wall 41, and a second compartment 60 may be formed contiguous with the other side wall 41 to enclose a VCR. A conduit running from the TV compartment 62 to the VCR compartment 60 is preferred for housing cable electrically connecting the VCR and television. With reference to FIGS. 4, 5, and 8, the top enclosure 40 includes a plurality of louvered partition supports 48 preferably running lengthwise for securing a plurality of louvers 49 and light fixtures 43,45. The louvers 49 may be rotatable for adjusting light into the modular bank facility 10 and for adjusting the escape of heat and the intake of conditioned air for cooling. Referring to FIGS. 5 and 7, a plurality of light supports 43 are connected to the louver partition supports 48 and project upward therefrom. At least one light fixture 45 is attached to each support 43. These light fixtures 45 provide light inside the bank enclosure 10. Alternatively, fluorescent lights 50 may be used. Any lights employed are supplied power through the station outlets.

The modular bank facility 10 of the instant invention is preferably constructed from wood materials. The side walls 12 and rear wall panels **30*a*, 30*b* may be framed with a plurality of ½ inch to two (2) inch thick plywood studs 72,70 and are preferably framed with ¾ inch thick studs spaced a predetermined distance off center. The studs are enclosed with plywood. That is, the side walls 12 and rear wall panels 30*a*,*b* may be constructed from plywood ranging between ¼ inch to ¾ inch. However, ¼ inch plywood is preferred. The studs 72,70 also provide thickness to the side walls 12 and rear wall 30 to facilitate the attachment of a door 14 and to provide support to the top enclosure 40. Once constructed, the side walls 12 and rear wall 30 are preferably three (3) inches thick and may be between two (2) and five (5) inches thick. The thickness facilitates balance, support, and secured attachment of the top enclosure 40. The walls 12, 30 are preferably finished with a ¼ inch thick laminate exterior. Likewise, the top enclosure side panels 41, rear panel 46, and front panel 42 may be constructed from ¼ inch to ¾ inch wood. The perimeter wall structure of the top enclosure 40** is preferably framed with a plurality of ¼ inch to one (1) inch thick plywood studs and preferably enclosed with a ¼ inch to ¾ inch laminate plywood exterior. The louver supports preferably comprise ½ to one (1) inch by four (4) to five (5) inch wood studs. The front counter enclosure 20 is also constructed from plywood, and is preferably framed with a plurality of wood frame studs 74, such as those disclosed herein, for structural integrity.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A transportable bank facility having discrete, complementary sections for convenient assembly in existing building environments to store banking related equipment and to provide banking related services to customers, via at least one teller, at a location remote from a parent bank and branch banks, said facility comprising:

ceiling means for enclosing a top end of said facility;

counter means, positioned below said ceiling means, for storing banking related equipment and transacting banking related services, wherein said counter means further comprises a drop box means for depositing banking related papers, said drop box means comprising a cutout in said counter means accessible from outside said facility, and a depository in communication with said cutout; and enclosure means, positioned behind said counter means and below said ceiling means, for defining an interior office volume when engaged with said counter means and said ceiling means, said enclosure means supporting said ceiling means from an upper end, said counter means and said ceiling means defining a facility opening therebetween for enabling interaction between the customers and the teller.

2. A facility as recited in claim 1, wherein said enclosure means defines an upper end and said ceiling means defines a lower end, said upper end and said lower end having complementary contours for securely joining together in a convenient modular connection to support said ceiling means.

3. A facility as recited in claim 2, wherein said enclosure means defines a front end and said counter means defines a rear end, a portion of said front end and said rear end having complementary contours for joined together in a convenient modular connection.

4. A facility as recited in claim 1, wherein said ceiling means comprises a controlling means for mechanically controlling light and ventilation inside said interior volume.

5. A facility as recited in claim 4, wherein said controlling means comprises:

at least one vent opening defined by said ceiling means in communication with said interior volume; and a plurality of louvers mounted in said vent opening for directing light and air entering and leaving said interior volume.

6. A facility as recited in claim 1, further comprising:

means for selectively equipping said facility with banking equipment, said equipping means being accessible from inside said interior office volume for enabling said facility to offer the banking related services.

7. A facility as recited in claim 2, wherein said equipping means comprises:

means for selectively receiving electrical power from the existing building environment for enabling operation of banking equipment requiring power; and means for selectively providing telecommunication service for enabling communication with the parent bank, branch banks, and customers.

8. A facility as recited in claim 1, wherein said ceiling means further comprises:

electrical means for receiving and providing electrical power to said ceiling means for powering selected electrical components supported by said ceiling means.

9. A facility as recited in claim 8, wherein said selected electrical components comprise a video means for running and displaying preselected videos viewable from outside said facility for promoting services offered by said facility.

10. A facility as recited in claim 8, wherein said selected electrical components comprise at least one light source for providing light inside said interior office volume.

11. A facility as recited in claim 1, wherein said counter means comprises a customer interface means for transacting business related services between the teller and the customers.

12. A facility as recited in claim 11, wherein said customer interface means comprises a customer window defined by said counter means below said facility opening.

13. A facility as recited in claim 12, wherein said counter means further comprises a means for controlling customer traffic, said traffic controlling means being defined by an exterior surface of said counter means.

14. A facility as recited in claim 12, wherein said counter means further comprises a communication station for selectively equipping said facility with the banking equipment, said communication station being accessible from inside said interior office volume for enabling said facility to offer the banking related services.

15. A facility as recited in claim 14, further comprising:

means for selectively receiving electrical power from the existing building environment for enabling operation of selected banking equipment; and means for selectively providing telecommunication service inside said facility for enabling communication with the parent bank, branch banks, and customers.

16. A facility as recited in claim 15, further comprising a plurality of banking equipment supported by said counter means for providing banking related services.

17. A facility as recited in claim 16, wherein said banking equipment comprises:

a graphic transmission means, in communication with said telecommunication service providing means, for receiving and transmitting documents;

a telecommunication means, in communication with said telecommunication service providing means, for communicating with locations outside said facility; and document reproduction means for duplicating documents used in providing banking related services.

18. A facility as recited in claim 12, wherein said counter means further comprises a control station means for controlling banking related information used in providing banking related services, said control station means being accessible from inside said interior office volume.

19. A facility as recited in claim 18, wherein said control station means comprises a computer means, in selective communication with the parent bank and the branch banks, for processing banking related customer data via computer communication.

20. A facility as recited in claim 19, wherein said banking control station means further comprises:

at least one monitor in electrical communication with said computer means for viewing selected customer data controlled by said computer means; and printer means, in electrical communication with said computer means for printing selected customer data.

21. A facility as recited in claim 11, wherein said counter means further comprises a vault means for securing and storing money to decrease risk of theft.

22. A facility as recited in claim 1, wherein said enclosure means comprises a plurality of panels having complementary side ends secured together, said panels each having an upper end secured to said ceiling means for supporting said ceiling means.

23. A facility as recited in claim 22, wherein said plurality of panels comprises at least two side panels and one back panel secured in between said at least two side panels.

24. A facility as recited in claim 23, wherein said side panels each define a front end, and wherein said counter means defines a rear end, a portion of said front end and said rear end having complementary contours for securely joining together.

25. A facility as recited in claim 1, further comprising a platform means, positioned below said enclosure means, for supporting said enclosure means and for routing electrical lines and telecommunication lines used with the banking related equipment.

26. A facility as recited in claim 25, wherein said platform means comprises a plurality of channels for running electrical lines and telecommunication lines.

27. A facility as recited in claim 1, further comprising:

means for providing security to said facility for decreasing risk of theft of the banking equipment and money in said facility.

28. A facility as recited in claim 27, wherein said security means comprises an electric alarm wired into said facility for triggering said alarm under predetermined conditions.

29. A facility as recited in claim 28, wherein said security means further comprises a control pad in electrical communication with said electric alarm for controlling said predetermined conditions.

30. A facility as recited in claim 27, wherein said security means comprises a retractable security door attached to said ceiling means at one end in substantial alignment with said facility opening, said door being extendable for closing off said facility opening and retractable for opening up said facility opening.

31. A facility as recited in claim 27, further comprising a video monitoring means, secured in said facility, for monitoring activity outside and inside said facility.

32. A transportable bank facility having discrete, complementary, interrelated mating sections that are removably securable for convenient assembly in existing building environments to store banking related equipment and to provide banking related services to customers, via at least one teller, at a location remote from a parent bank and branch banks, said facility comprising:

ceiling means for enclosing a top end of said facility, said ceiling means defining a lower end;

counter means, positioned below said ceiling means lower end, for storing banking related equipment and transacting banking related services, said counter means defining a rear end, wherein said counter means further comprises a drop box means for depositing banking related papers, said drop box means comprising a cutout in said counter means accessible from outside said facility, and a depository in communication with said cutout;

enclosure means, positioned behind said counter means and below said ceiling means, for defining an interior office volume when engaged with said counter means and said ceiling means;

said enclosure means defining an upper end and a front end, said enclosure upper end and said ceiling lower end having complementary contours for joining together in modular connection to support said ceiling means, a portion of said enclosure front end and said counter rear end having complementary contours for joining together in modular connection; and a facility opening defined between said counter means and said ceiling means when said ceiling means, said enclosure means and said counter means are joined for enabling interaction between the customers and the teller in providing the banking related services.

33. A facility as recited in claim 32, wherein said ceiling means further comprises a controlling means for mechanically controlling light and ventilation inside said interior volume.

34. A facility as recited in claim 33, wherein said controlling means comprises:

at least one vent opening defined by said ceiling means in communication with said interior volume; and a plurality of louvers mounted in said vent opening for directing light and air entering and leaving said interior volume.

35. A facility as recited in claim 32, further comprising:

means for selectively receiving electrical power from the existing building environment for enabling operation of banking equipment requiring power; and means for selectively providing telecommunication service for enabling communication with the parent bank, branch banks, and customers.

36. A facility as recited in claim 35, wherein said counter means comprises a customer interface means for transacting business related services between the teller and the customers.

37. A facility as recited in claim 36, wherein said customer interface means comprises a customer window defined by said counter means below said facility opening.

38. A facility as recited in claim 32, wherein said counter means further comprises a means for controlling customer traffic, said traffic controlling means being defined by an exterior surface of said counter means.

39. A facility as recited in claim 35, wherein said counter means further comprises a communication station for selectively equipping said facility with the banking equipment, said communication station being accessible from inside said interior office volume for enabling said facility to offer the banking related services.

40. A facility as recited in claim 39, wherein said banking equipment comprises:

a graphic transmission means, in communication with said telecommunication service providing means, for receiving and transmitting documents;

a telecommunication means, in communication with said telecommunication service providing means, for communicating with locations outside said facility; and document reproduction means for duplicating documents used in providing banking related services.

41. A facility as recited in claim 35, wherein said counter means further comprises a control station means for controlling banking related information used in providing banking related services, said control station means being accessible from inside said interior office volume.

42. A facility as recited in claim 41, wherein said control station means comprises a computer means, in selective communication with the parent bank and the branch banks, for processing banking related customer data via computer communication.

43. A facility as recited in claim 35, wherein said counter means further comprises a vault means for securing and storing money to decrease risk of theft.

44. A facility as recited in claim 35, wherein said enclosure means comprises a plurality of panels having complementary side ends secured together, said panels each having an upper end secured to said ceiling means for supporting said ceiling means.

45. A facility as recited in claim 44, wherein said plurality of panels comprises at least two side panels and one back panel secured in between said at least two side panels.

46. A facility as recited in claim 45, wherein said side panels each define a front end, and wherein said counter means defines a rear end, a portion of said front end and said rear end having complementary contours for securely joining together.

47. A facility as recited in claim 35, further comprising a platform means, positioned below said enclosure means, for supporting said enclosure means and for routing electrical lines and telecommunication lines used with the banking related equipment.

48. A facility as recited in claim 47, wherein said platform means comprises a plurality of channels for running electrical lines and telecommunication lines.

49. A facility as recited in claim 35, further comprising:

security means, in electrical communication with said electrical power receiving means, for providing security to said facility for decreasing risk of theft of the banking equipment and money in said facility.

50. A facility as recited in claim 49, wherein said security means comprises an electric alarm wired into said facility for triggering said alarm under predetermined conditions.

51. A facility as recited in claim 50, wherein said security means further comprises a control pad in electrical communication with said electric alarm for controlling said predetermined conditions.

52. A facility as recited in claim 50, wherein said security means further comprises a retractable security door attached to said ceiling means at one end in substantial alignment with said facility opening, said door being extendable for closing off said facility opening and retractable for opening up said facility opening.

53. A facility as recited in claim 49, further comprising a video monitoring means, secured in said facility, for monitoring activity outside and inside said facility.

* * * * *